US007207623B2

(12) United States Patent
Milinov et al.

(10) Patent No.: US 7,207,623 B2
(45) Date of Patent: Apr. 24, 2007

(54) ITEM OF TRANSFORMABLE FURNITURE

(75) Inventors: Ilian Vladimirov Milinov, Sofia (BG); Anton Kolev Dantchev, Sofia (BG)

(73) Assignee: JRT Joint-Stock Company, Sofia (BG)

( * ) Notice: Subject to any disclaimer, the term of this patent is extended or adjusted under 35 U.S.C. 154(b) by 4 days.

(21) Appl. No.: 10/526,310

(22) PCT Filed: Jan. 23, 2003

(86) PCT No.: PCT/IB03/00158

§ 371 (c)(1),
(2), (4) Date: Mar. 2, 2005

(87) PCT Pub. No.: WO2004/019730

PCT Pub. Date: Mar. 11, 2004

(65) Prior Publication Data

US 2006/0055213 A1 Mar. 16, 2006

(30) Foreign Application Priority Data

Sep. 2, 2002 (BG) ..... 6513
Nov. 19, 2002 (BG) ..... 107294

(51) Int. Cl.
*A47B 85/04* (2006.01)

(52) U.S. Cl. ..... 297/124

(58) Field of Classification Search ..... 297/124, 297/128, 1–3, 118, 119, 129
See application file for complete search history.

(56) References Cited

U.S. PATENT DOCUMENTS 1,157,802 A * 10/1915 Persson ..... 297/109
1,425,354 A 8/1922 Worthington et al.
1,937,886 A * 12/1933 Grose ..... 297/122
2,595,179 A 4/1952 Vella
2,658,554 A 11/1953 Specter et al.
2,888,062 A * 5/1959 Lockwood ..... 297/122
2,931,425 A * 4/1960 Rasco et al. ..... 297/124
2,938,572 A * 5/1960 Solloway et al. ..... 297/296
3,352,602 A 11/1967 Svendsen
3,554,597 A 1/1971 Gurbst
3,589,715 A * 6/1971 Mark et al. ..... 297/316
4,427,232 A 1/1984 Malm
4,937,900 A * 7/1990 Bridges ..... 297/342

(Continued)

FOREIGN PATENT DOCUMENTS

CN 92111940.2 7/1993

(Continued)

*Primary Examiner*—Peter R. Brown
(74) *Attorney, Agent, or Firm*—Standley Law Group LLP

(57) ABSTRACT

The invention relates to an item of transformable furniture, in particular to a chair that transforms into a desk and vice cersa. An item of transformable furniture consisting of two substantially flat elements (5) and (6) connected with each other, which can switch over between a first position as a seat (6) and a back (5) and a second position as a front panel (6) and a worktop (5) and vice versa. The item of transformable furniture is provided with a supporting construction for the two substantially flat elements (5), (6). The supporting construction consists of two linked lateral vertical elements (1) located at a distance from one another, where the two substantially flat elements are located between the two linked lateral vertical elements (1).

20 Claims, 12 Drawing Sheets

U.S. PATENT DOCUMENTS

| | | | | |
|---|---|---|---|---|
| 5,833,306 | A * | 11/1998 | Breto | 297/124 |
| 6,428,094 | B1 | 8/2002 | Ruiter | |
| 6,883,863 | B2 | 4/2005 | Ginns | |

FOREIGN PATENT DOCUMENTS

| | | |
|---|---|---|
| DE | 296 12 131 | 10/1996 |
| EP | 0 447 925 | 9/1991 |
| GB | 195 545 | 4/1923 |
| GB | 702965 | 1/1954 |
| GB | 1190221 | 4/1970 |
| GB | 1198356 | 7/1970 |

* cited by examiner

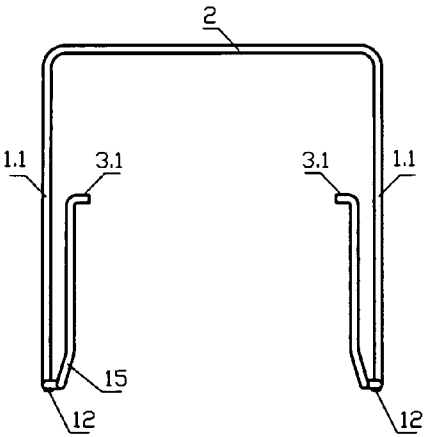
Figure. 7a
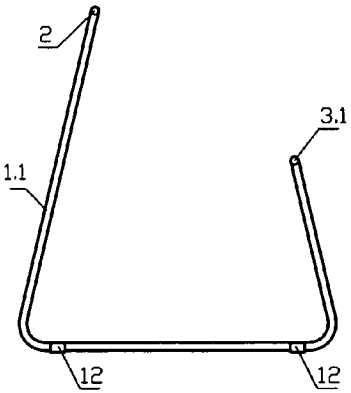
Figure. 7b
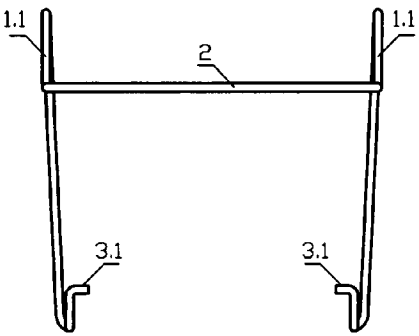
Figure. 7c
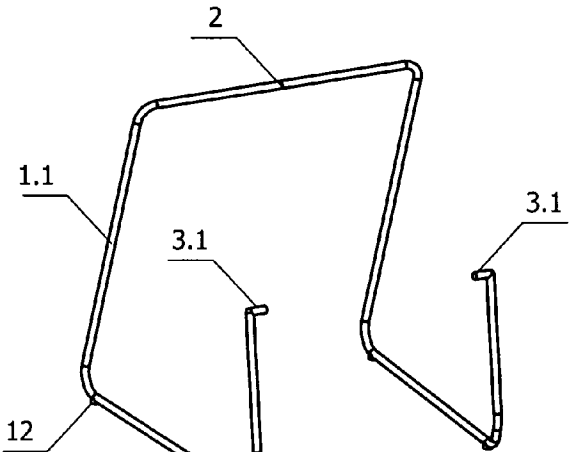
Figure. 7d
Figure. 7

13.2.e
2
9
5.1
13.2.A
13.2.b
13.2.d
13.2.f
13.2.c
9
13.2.a 9
13.2.b
2

13.2.A
13.2.b
14
13.2.e
2
14
5.1

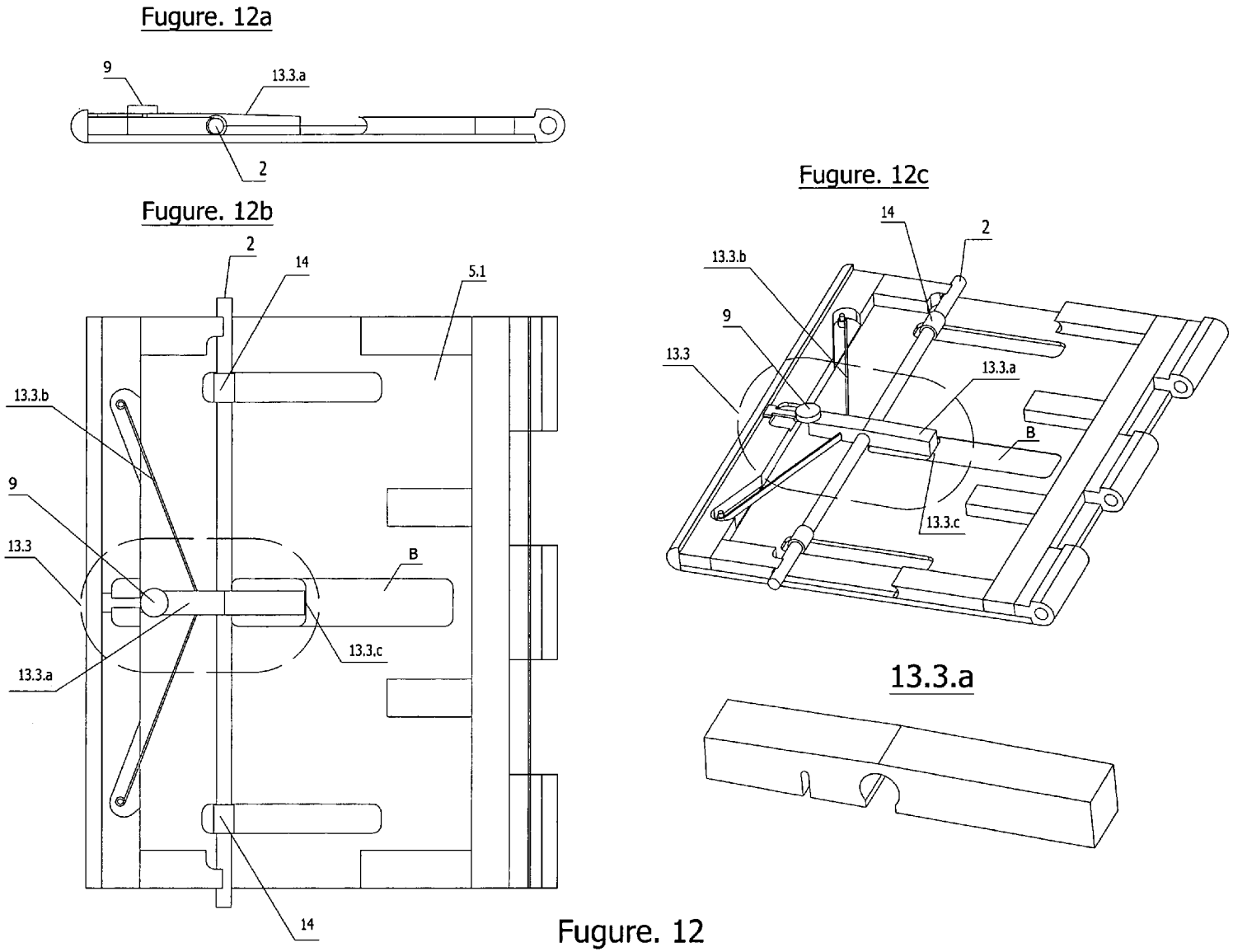
Fugure. 12a
9
13.3.a
2
Fugure. 12b
2
14
5.1
B
13.3.c
14
13.3.b
9
13.3
13.3.a
Fugure. 12c
2
14
13.3.a
B
13.3.c
13.3.b
9
13.3
13.3.a
Fugure. 12

ITEM OF TRANSFORMABLE FURNITURE

The invention relates to an item of transformable furniture, in particular to a chair that transforms into a desk and vice versa. Its application is in the furniture industry and can be used for example in conference rooms, offices, training rooms, the home and public areas.

The object of the invention is to provide an item of furniture, in particular a chair that transforms into a desk and vice versa, said furniture having a simple construction that ensures stability as well as easy and simple transformation.

The object of the invention is achieved by the combination of the features defined in claim 1. Preferable embodiments of the furniture according to the invention are set forth in the subclaims.

According to an embodiment of the invention there is provided a chair that transforms into a desk, consisting of two substantially flat elements connected with each other, which switch over between a first position as seat and back and a second position as a front panel/face surface and worktop, respectively. The two substantially flat elements upon switching over from a first position to a second position and vice versa fall essentially in the same plane.

A preferable embodiment of the chair provides two connected substantially flat elements mounted on a supporting construction, consisting of two linked lateral vertical elements, located at a distance from one another. In the space limited by the two lateral vertical elements there are arranged two substantially flat elements. In the form of a chair the first substantially flat element of the furniture forms a back, whereas in the form of a desk the first substantially flat element moves in another substantially horizontal position where it forms a worktop. In the form of a chair the second substantially flat element of the furniture forms a seat, whereas in the form of a desk the second substantially flat element moves in another substantially vertical position where it forms a front panel of the desk.

In another preferred embodiment of the invention, the supporting construction has two parallel horizontal axes located at different levels, said axis being fixed permanently to two lateral vertical elements. The two substantially flat elements are linked with a hinge joint whose axis is parallel to the horizontal axes. The first substantially flat element is connected with the top horizontal axis by means of a slot, or a mechanism which enables the substantially flat element to make a rotating and translation movement against the axis. The second substantially flat element is connected with the bottom horizontal axis, whereby the latter goes through the former, or the flat element lying on top of the axis, or by means of a mechanism which enables the substantially flat element to make a rotating motion against the axis. In an alternative option, the second substantially flat element is connected with the bottom horizontal axis by means of a slot, or a mechanism, whereby the second substantially flat element makes a rotating and translation movement against the bottom horizontal axis, while the first substantially flat element is connected with the top horizontal axis, whereby the axis goes through the substantially flat element, or the substantially flat element lies on top of the axis, or by means of a mechanism, allowing the substantially flat element to make a rotating movement against the axis. In the transformation from position chair into position desk, from its vertical or nearly vertical position, the first substantially flat element-back is positioned in horizontal or nearly horizontal position as a desk top, while the second substantially flat element-seat, from horizontal or nearly horizontal position, is positioned into vertical or nearly vertical position as a front panel.

In the form of a chair the first substantially flat element and the second substantially flat element of the furniture preferably form an angle between 80° and 130°, more preferably an angle between 100° and 105°. Here the bottom horizontal axis connects the two lateral vertical elements in a place that determines the height of the position of the second substantially flat element, which is a seat, in relation to the floor.

In the form of a desk the first substantially flat element and the second substantially flat element of the furniture preferably form an angle between 80° and 130°, more preferably an angle between 100° and 105°. Here the top horizontal axis connects the two lateral vertical elements in a place that determines the height of the position of the first substantially flat element, which is the desk top, in relation to the floor.

According to a still preferred embodiment one of the horizontal axes can consist of two half-axes mounted on the substantially flat element.

In the process of transformation the hinge joint ensures a smooth change of the position of the two substantially flat elements in relation to each other: increasing the angle formed between the substantially flat elements, and vice versa. In the process of transformation the slot ensures the translation movement of the substantially flat element it is located in, or which contains the mechanism, respectively, in relation to the respective horizontal axis during the rotation of each substantially flat element around the horizontal axis connected with it, and the transition of the substantially flat element from vertical or nearly vertical position in horizontal or nearly horizontal position, and vice versa. In the form of a chair the axis of the hinge joint is on the same or nearly the same level with the bottom horizontal axis. During the transformation into a desk, the axis of the hinge joint moves to one and the same or nearly the same level with the top horizontal axis. The positions of the top and bottom horizontal axes remain unchanged.

The two lateral vertical elements can be optionally formed as frames having closed or open contour. The lateral vertical elements can be formed in any other suitable geometric shape, preferably as a panel-like lateral elements. The lateral vertical elements can be made of metal, plastic, medium density fibre board (MDF), solid wood, plywood, solid HPL, or other suitable material; their construction can be non-dismountable or dismountable.

When viewed from above the two lateral vertical elements can be preferably parallel to one another or to be located in an angle. The advantage of the latter position is that it allows the lateral elements of the article in a position of a chair to go between the lateral elements of the article in a position of a disk, thereby allowing the two articles to be used as a set. The construction of the lateral elements of the article is such so as to allow it to stack in a position of a chair and in a position of a desk.

The two substantially flat elements can be made of solid wood; plywood; solid wood and plywood; medium density fiberboard (MDF); MDF and solid wood, solid HPL, or other suitable material.

For the sake of comfort for the transformation, it is possible to make a handle in one of the substantially flat elements.

The chair that transforms into a desk is preferably equipped with a fixing mechanism to ensure stability in either position, chair or desk, and to ease the transformation.

The fixing mechanism serves as a positioning and locking device of the chair that transforms into a desk and vice versa, and can be mounted in the first substantially flat element, in the second substantially flat element or in the hinge joint.

According to a first preferable embodiment the fixing mechanism consists of a tie bar, joined to a spring at one of its ends; the other end is free. The tie bar is located perpendicularly to the top horizontal axis, passed above and holds it. At its other end, the spring is joined to the body of the first substantially flat element. The tie bar has an integrated blocking step. Mounted in the first substantially flat element are a blocking element and a release button, located in a special socket in the cover, above the step of the tie bar.

According to a second preferable embodiment the fixing mechanism consists of a locking pin, spring, located under the button, a slider which has a hole for the top horizontal axis to go. An axis goes through the slider, joined to which are two elastic bands. At their other end, the elastic bands are joined to the body. The spring holds the locking pin in a permanent locked position.

According to a third preferable embodiment of the fixing mechanism, it consists of the same elements like in the second embodiment, where however the elastic bands are replaced by a helical spring. At the one end the helical spring is joined to the axis of the hinge joint and at the other it is fixed to the body be means of a bush and pin. The axis of the hinge joint is fixed to the body of the second substantially flat element. The helical spring is tensed in such a way so as to keep the item in position desk. The transformation into position chair has to overcome the resistance of the spring. In the transformation to position desk, the spring helps the movement.

A fourth embodiment of the fixing mechanism according to the invention consists of a pin through which goes the top horizontal axis. The pin is blocked in a blocking step; an elastic band, joined to the body, goes through the pin.

The advantages of the furniture according to the invention have many aspects. According to preferred embodiments mentioned above the supporting construction is simple, light, robust and stable. The axes of the supporting construction take part in the process of transformation and facilitate it. As a result, the piece of furniture has a simple construction and ensures stability in its end positions as chair or desk. The transformation from a chair into a desk and vice versa can be achieved by a simple and quick movement without unscrewing or screwing anything. The construction of the furniture as a chair that transforms into a desk, subject to the invention, uses simple hinge joints and axes, thereby ensuring cheap and quick manufacturing. Due to its simple and light construction and easy transformation, the piece of furniture has a broad field of applications, e.g. conference halls, offices, training rooms, the home, public areas, etc., as well as toys. Another advantage of the invention is that the article can be made from any type of suitable materials used in the furniture industry.

In the following the invention, it's function and advantages are further explained in detail by preferable embodiments with reference to the accompanying drawings.

Figure 1:
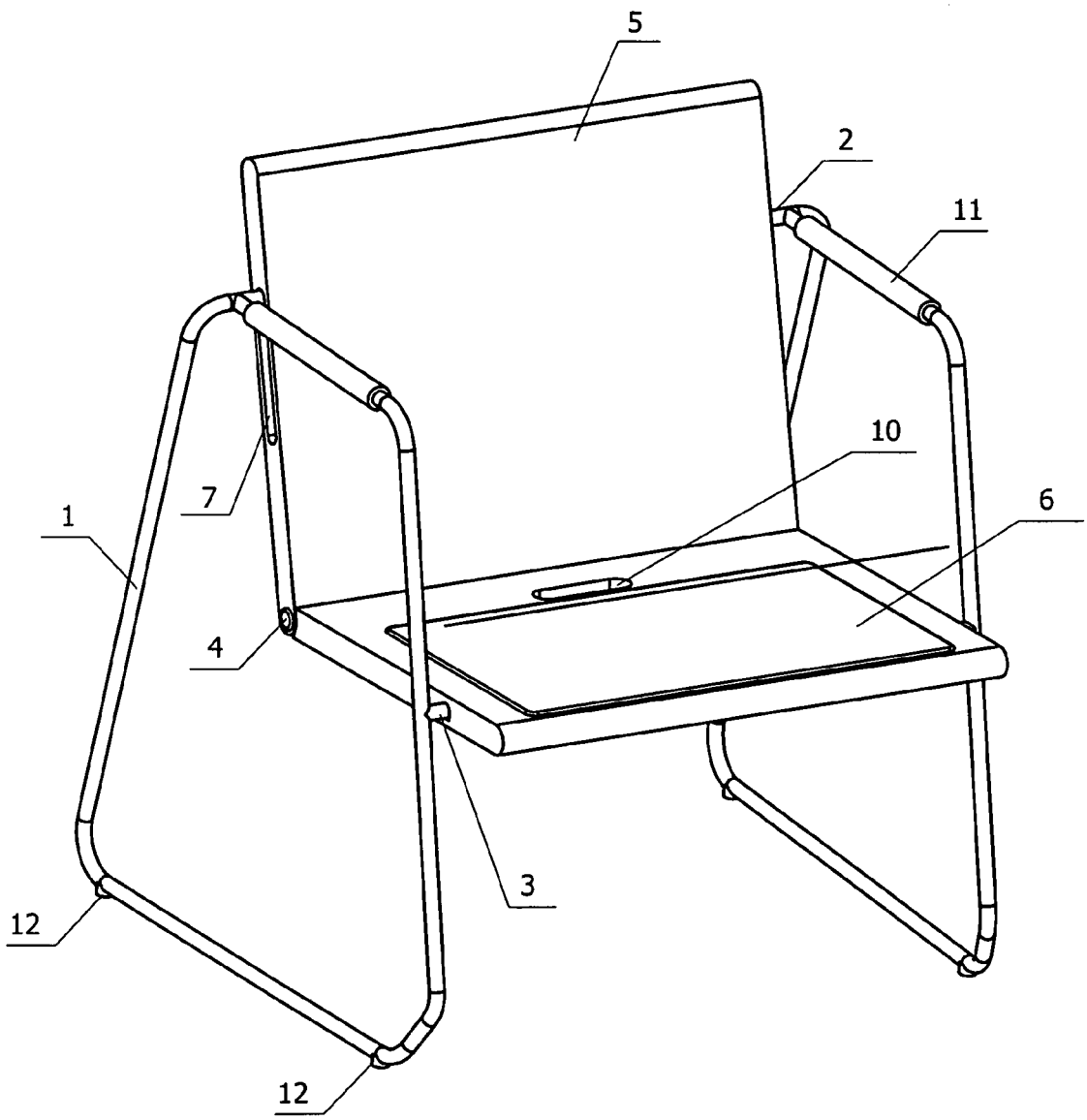
FIG. 1 is a perspective view of a first embodiment of the transformable furniture according to the invention in the form of a chair.
Figure 2:
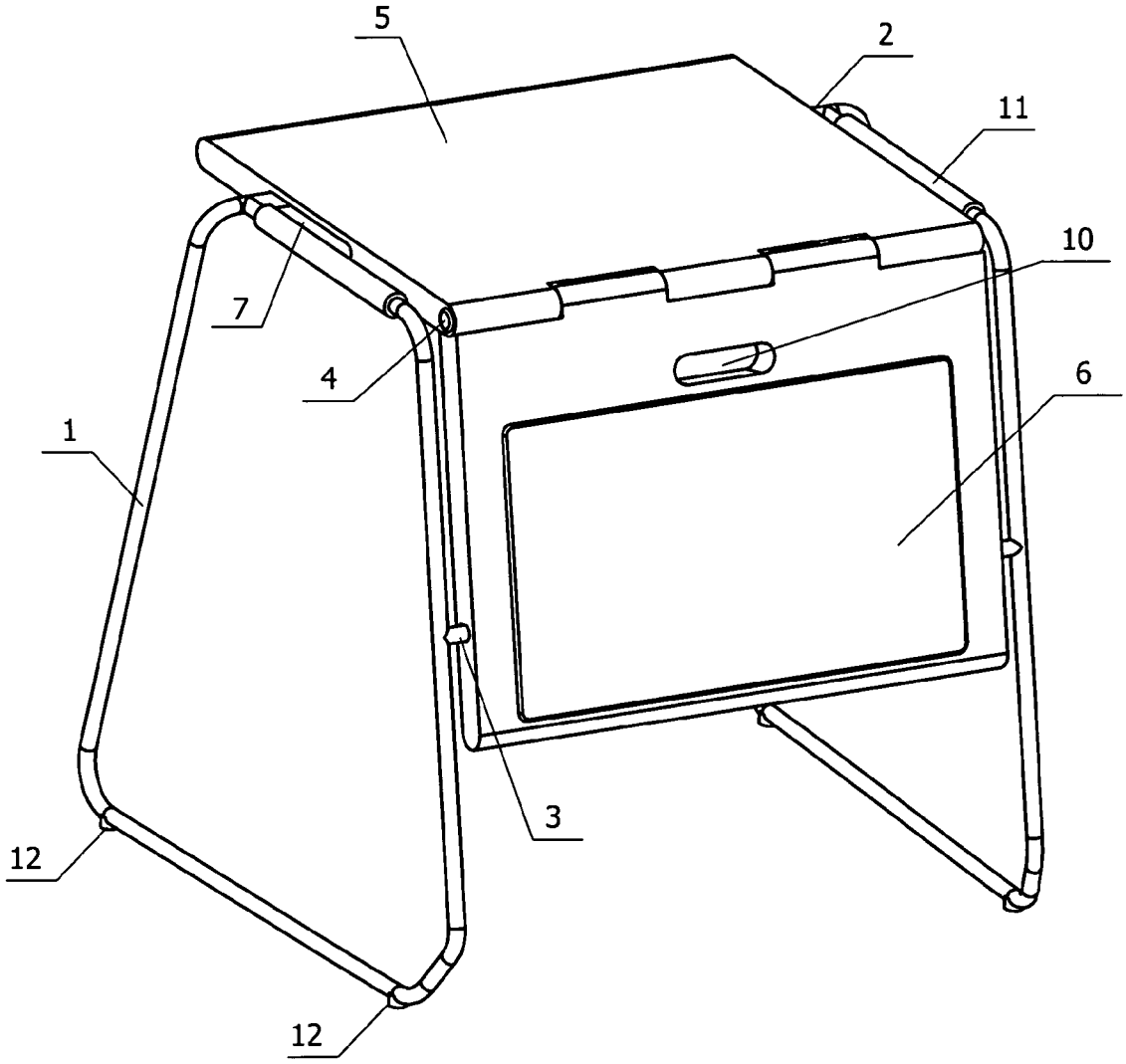
FIG. 2 is a perspective view of the first embodiment of the transformable furniture shown in FIG. 1 which has been transformed into a desk.
Figures 3, 3A, 3B, 3C, 3D:
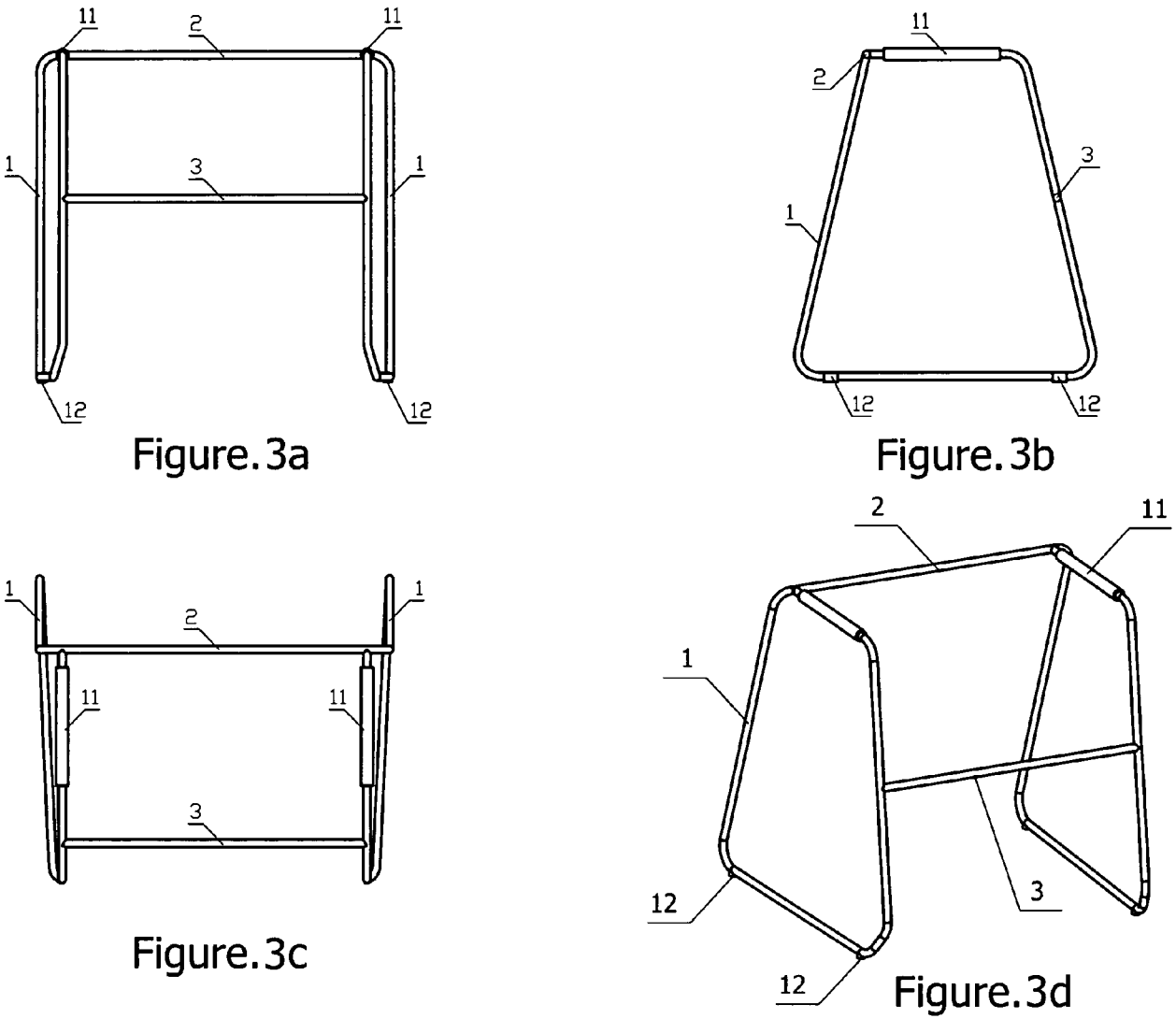
FIG. 3 shows different views of the supporting construction of the furniture according to FIGS. 1 and 2.
Figures 4, 4A, 4B, 4C, 4D, 4E:
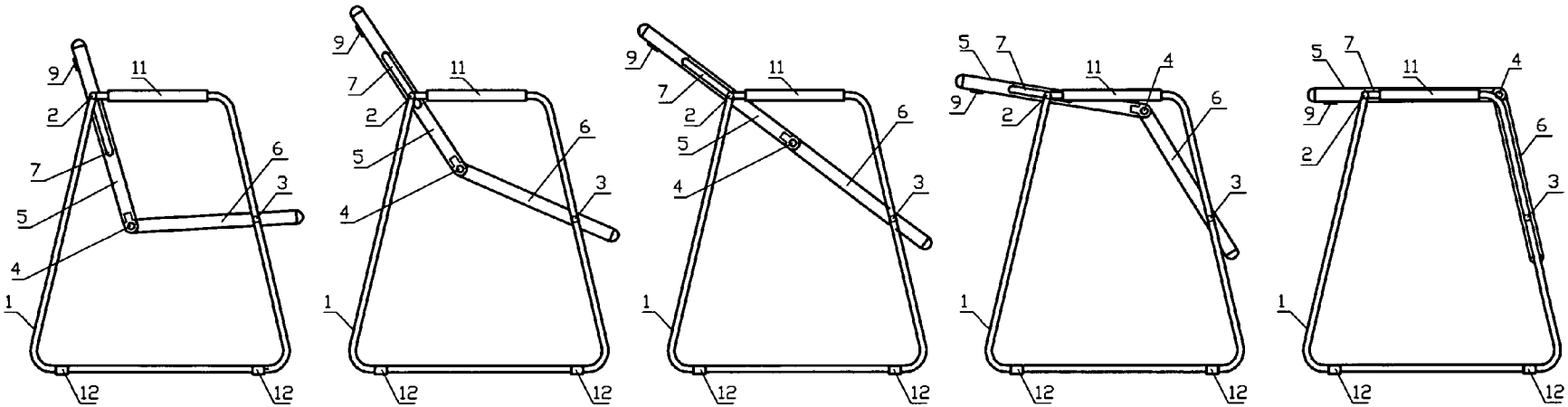
Figure 5:
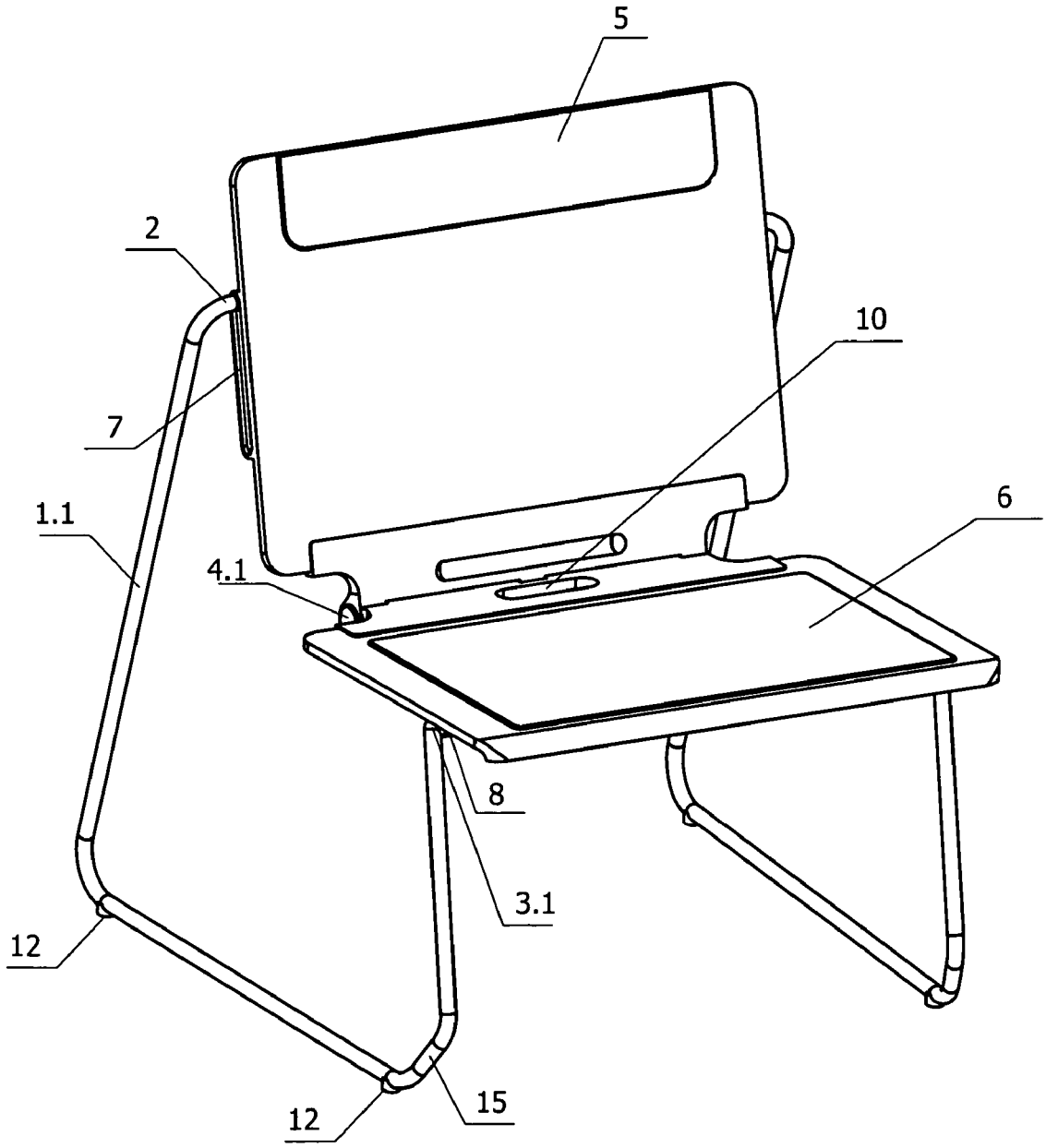
Figure 6:
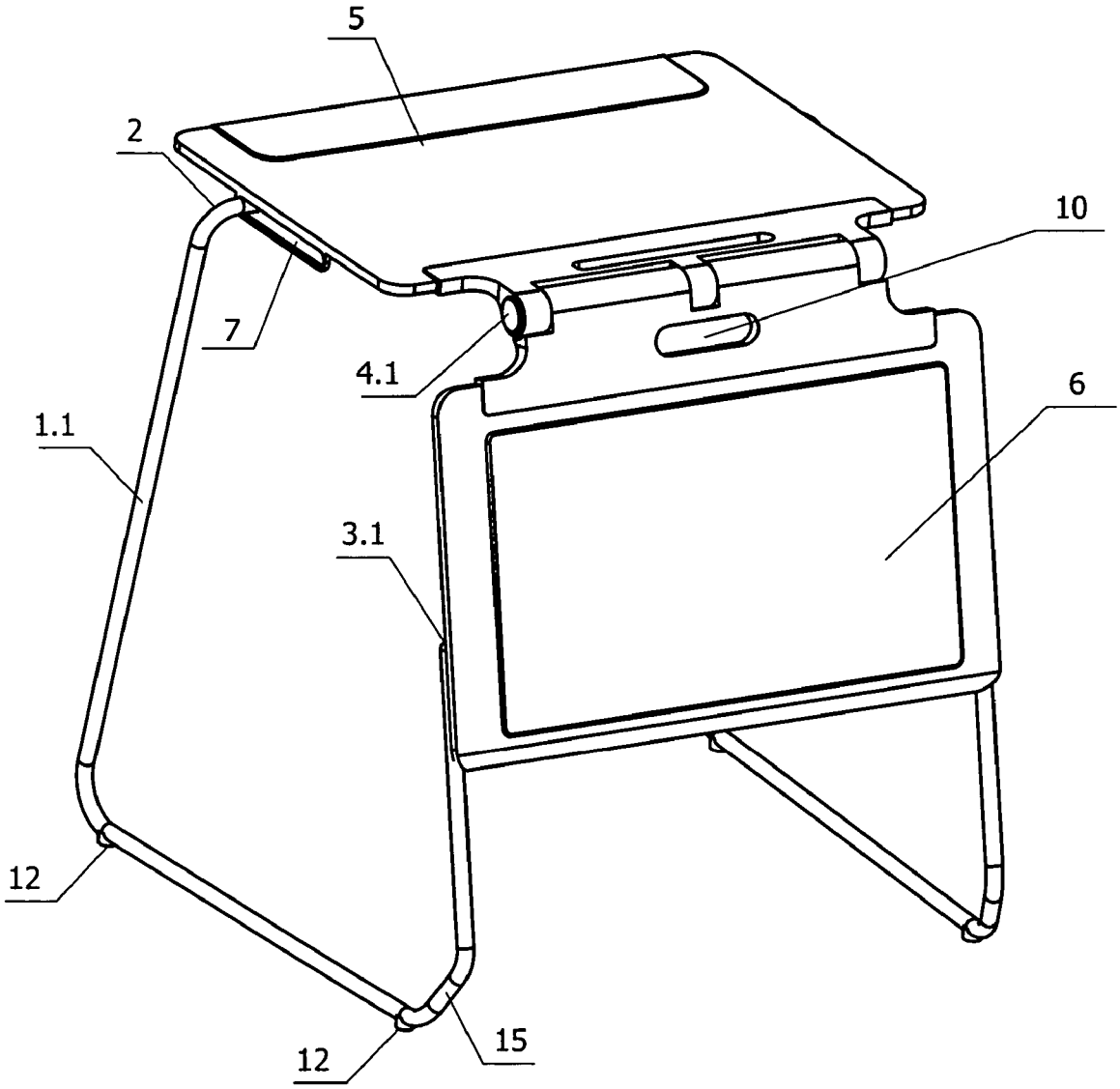
Figures 4E, 8, 8A, 8B, 8C, 8D:
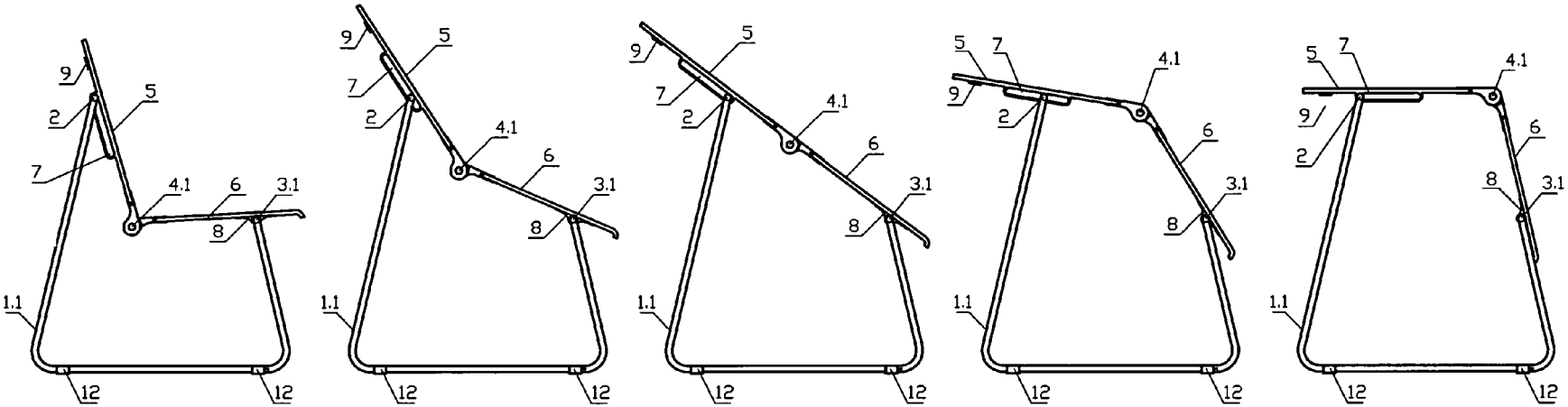
Figure 9:
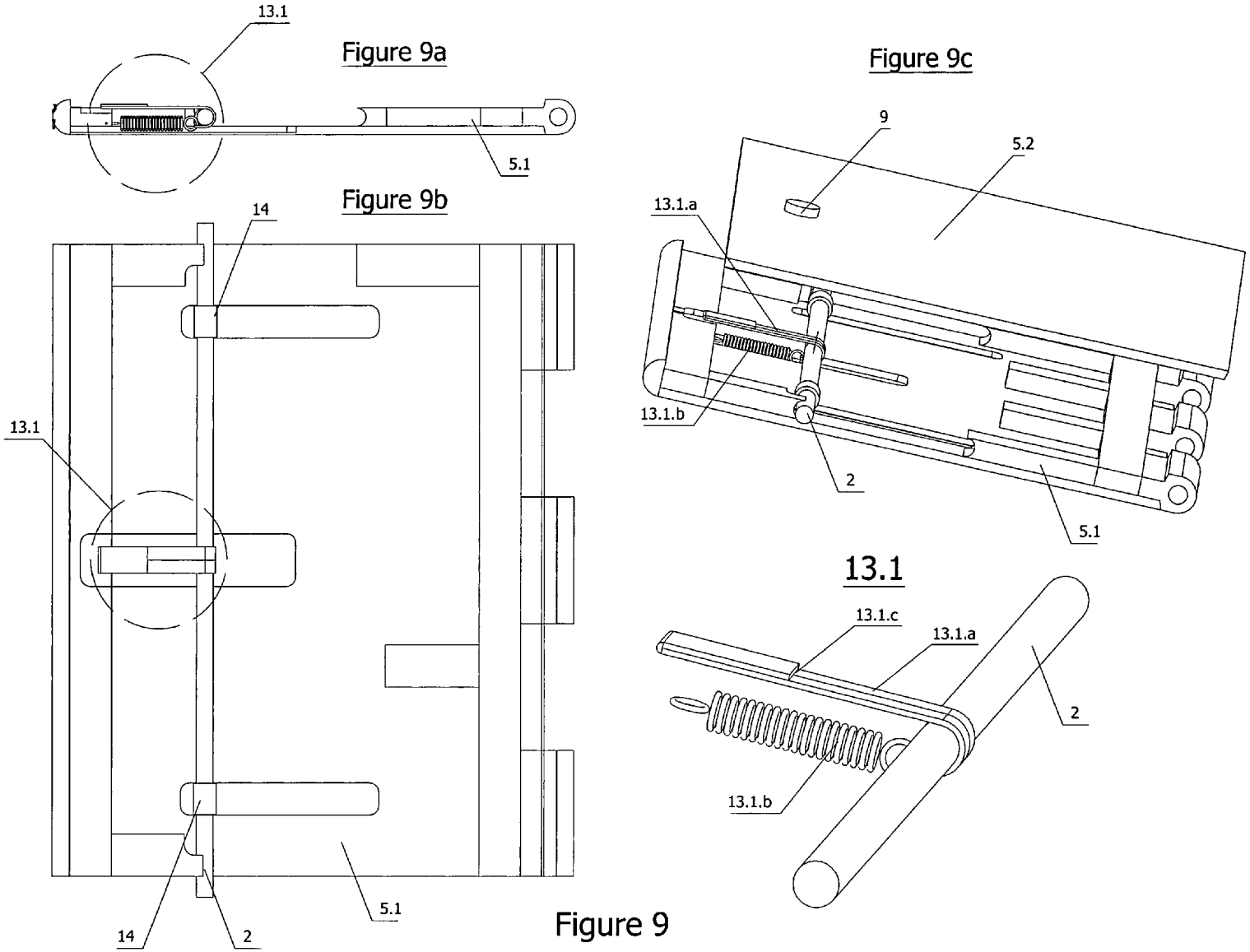

FIG. 3*a* is a front view of the supporting construction;

FIG. 3*b* is a side view of the supporting construction;

FIG. 3*c* is a top view of the supporting construction;

FIG. 3*d* is a perspective view of the supporting construction;

FIG. 4 is side view of the furniture according to FIGS. 1 and 2 showing the transformation from a chair into a desk (FIGS. 4*a*–4*e*);

FIG. 5 is a perspective view of a second embodiment of the transformable furniture according to the invention in the form of a chair;

FIG. 6 is a perspective view of the second embodiment of the transformable furniture shown in FIG. 5 which has been transformed into a desk;

FIG. 7 shows different views of the supporting construction of the furniture according to FIGS. 5 and 6;

FIG. 7*a* is a front view of the supporting construction;

FIG. 7*b* is a side view of the supporting construction;

FIG. 7*c* is a top view of the supporting construction;

FIG. 7*d* is a perspective view of the supporting construction;

FIG. 8 is side view of the furniture according to FIGS. 1 and 2 showing the transformation from a chair into a desk (FIGS. 8*a*–8*e*);

FIG. 9 shows a first embodiment of the fixing mechanism used in the transformable furniture according to the invention;

FIG. 9*a* is a side view of the fixing mechanism;

FIG. 9*b* is a top view of the fixing mechanism.

Figures 10, 10A, 10B, 10C:
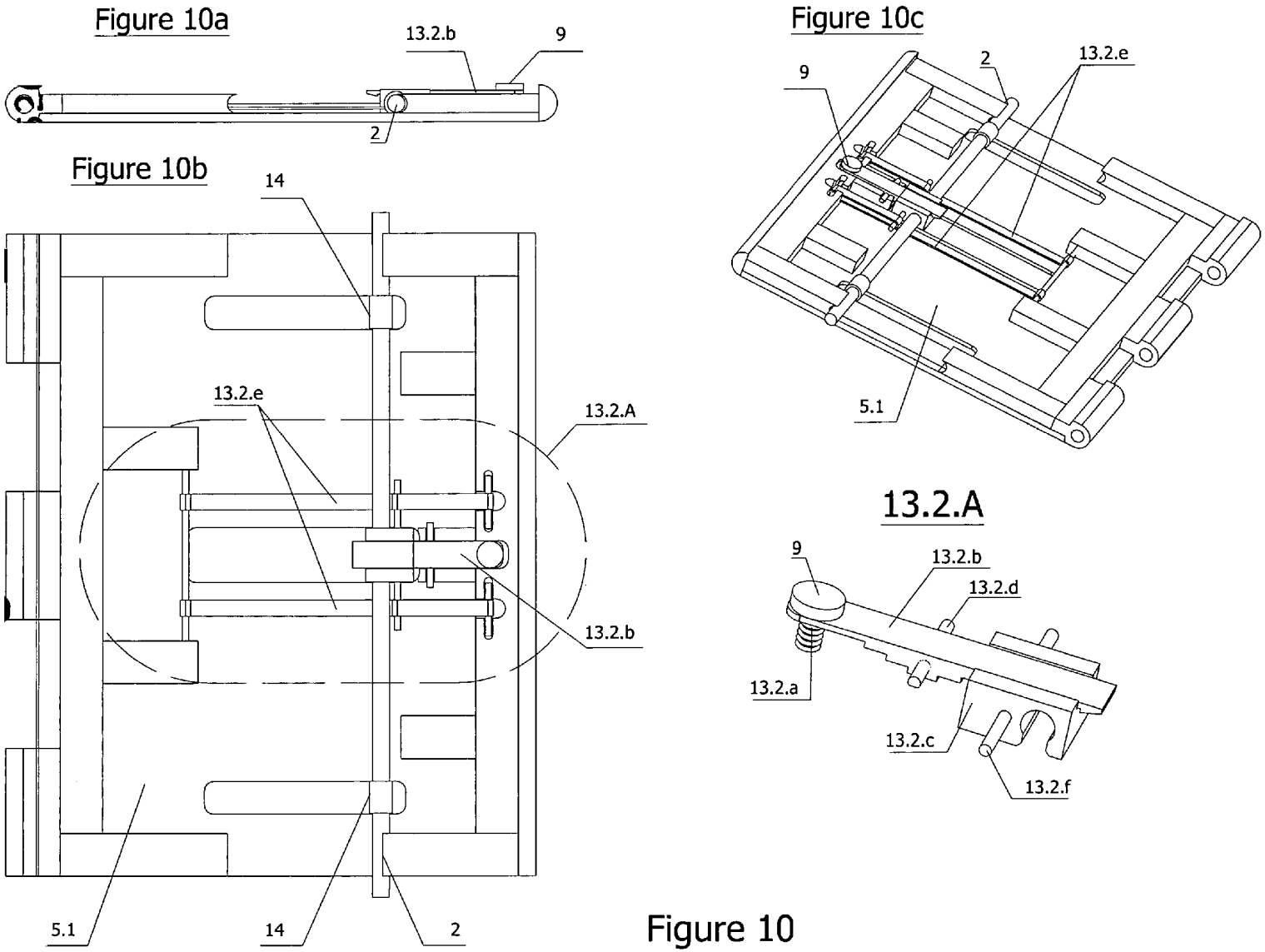

FIG. 9*c* is a perspective view of the fixing mechanism;

FIG. 10 shows a second embodiment of the fixing mechanism used in the transformable furniture according to the invention;

FIG. 10*a* is a side view of the fixing mechanism;

FIG. 10*b* is a top view of the fixing mechanism.

Figure 11:
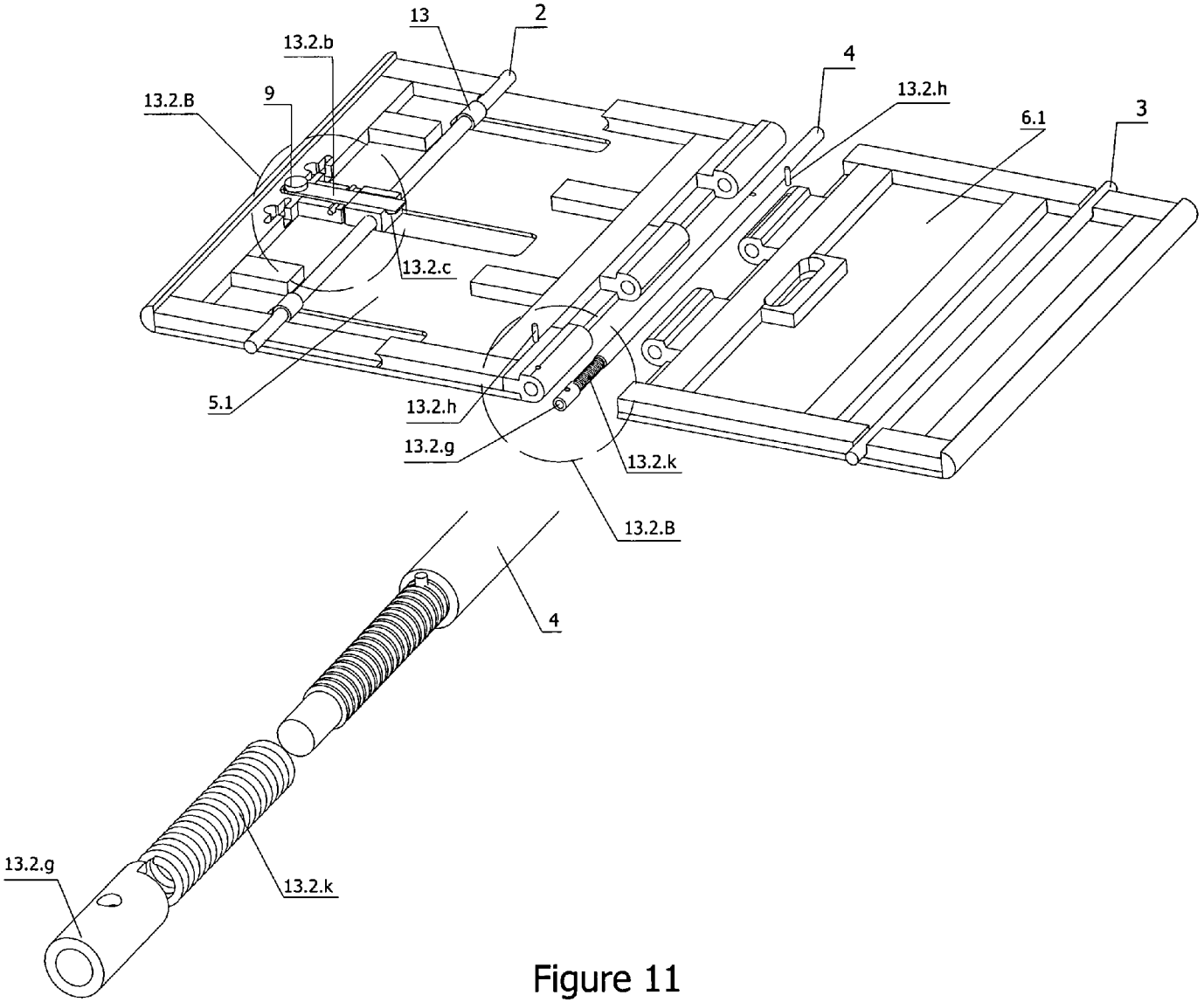

FIG. 10*c* is a perspective view of the fixing mechanism along with a separate enlarged view of the fixing mechanism;

FIG. 11 illustrates the mounting principle of a furniture comprising a fixing mechanism according to the second embodiment;

FIG. 12 shows a third embodiment of the fixing mechanism used in the transformable furniture according to the invention;

FIG. 12*a* is a side view of the fixing mechanism;

FIG. 12*b* is a top view of the fixing mechanism;

FIG. 12*c* is a perspective view of the fixing mechanism along with a separate enlarged view of the fixing mechanism.

DETAILED DESCRIPTION OF THE PREFERRED EMBODIMENTS

As shown in FIG. 1 a chair consists of a supporting construction, comprising two lateral vertical elements, linked with two horizontal axes located at different levels, namely a top horizontal axis 2 and a bottom horizontal axis 3. The two lateral vertical elements 1 are located in an angle. The lateral vertical elements are formed as metal pipe frame with trapezium shape if viewed from the side, resting on a pair of feet 12. In the upper part of the pipe frame there are armrests 11 made of plastic material. At the bottom front part of the metal pipe frame there is a special curve 15, which allows the article to be stacked. Two substantially flat elements, first substantially flat element 5 and second substantially flat element 6, linked with a hinge joint 4, are located in the space limited by the lateral vertical elements 1. The top horizontal axis 2 and the bottom horizontal axis 3 are parallel to one another and in relation to the axis of the hinge joint 4. The top horizontal axis 2 goes through the wall of the first substantially flat element 5, which can rotate around its axis. In a position of a chair the first substantially flat element 5 functions as a back and in a position of a desk, it functions as a desk top. The bottom horizontal axis 3 goes through the wall of the second substantially flat element 6, which can rotate around the same axis. In the position "chair" the second substantially flat element 6 is a seat and in the position "desk", it is a front panel. The wall of the first substantially flat element 5, which holds the top horizontal axis 2, has a slot 7, which allows the translation and rotating movement around axis 2. The chair has a fixing mechanism located in the first substantially flat element 5, covered with a cover on which button 9 is mounted. The second substantially flat element 6 has a handle 10, located near the hinge joint. The version is shown on FIGS. 1 to 4.

In another embodiment of the invention, shown on FIGS. 5 to 8, the lateral vertical elements 1.1 of the supporting constriction are formed as an open frame (FIG. 7), whose one end is connected with the top horizontal axis 2, and the other, with the bottom horizontal axis 3.1, executed as two half-axes, mounted on the second substantially flat element 6.

One version of execution of the fixing mechanism 13, shown on FIG. 9, consists of a tie bar 13.1.*a*, joined at one end to spring 13.1.*b*; the other end is free. The tie bar 13.1.*a* is located perpendicularly to the top horizontal axis 2, goes above it and holds it. At its other end the spring 13.1.*b* is joined to the body 5.1 of the first substantially flat element 5. The tie bar 13.1.*a* has an integrated blocking step 13.1.*c*. Mounted on the cover 5.2 of the first substantially flat element 5 are a blocking element, which is not shown on the figures, and a release button 9, located in a special socket in the cover 5.2, above the step of the tie bar. Using the fixing mechanism it is possible to unlock the chair by pressing button 9, whereby the blocking step 13.1.*c* of the tie bar 13.1.*a* is unblocked from the blocking element and the transformation starts. The guiding parts 14 position the axis 2 in relation to the first substantially flat element 5.

A second version of the execution of the fixing mechanism, shown on FIG. 10, consists of a locking pin 13.2.*b*, spring 13.2.*a*, located under button 9, slider 13.2.*c*, which has a hole for the axis 2 to go; axis 13.2.*f* which has two elastic bands 13.2.*e*, goes through the slider. The other end of the elastic band is joined to body 5.1. The spring 13.2.*a* holds the locking pin 13.2.*b* in permanent locked position. The unlocking takes place by pressing button 9 whereby the locking pin 13.2.*b* rotates around axis 13.2.*f*, unblocks from the slider 13.2.*c* and the transformation starts. The elastic band 13.2.*e* pulls substantially flat element 5 towards axis 2 and facilitates the movement until reaching en end position, chair or desk. When the end position is reached, substantially flat element 5 locks into position automatically.

A third version of the fixing mechanism, shown on FIG. 11, consists of the same elements as in the second version, but the elastic bands 13.2.*e* are replaced with a helical spring 13.2.*k*. At the one end, the spring 13.2.*k* is joined to the axis 4 of the hinge joint, and at the other, it is fixed to the body 5.1 by means of bush 13.2.*g* and pin 13.2.*h*. The axis 4 is fixed to the body 6.1 of the second substantially flat element 6. The helical spring 13.2.*k* is tensed in such a way so as to keep the item in position desk. The transformation into position chair has to overcome the resistance of the spring. In the transformation to position desk, the spring helps the movement.

A fourth version of the fixing mechanism, shown on FIG. 12 consists of a pin 13.3.*a* through which goes the top horizontal axis 2. The pin 13.3.*a* is blocked in a blocking step 13.3.*c*; an elastic band 13.3.*b* goes through the pin 13.3.*a*. The elastic band turns the pin around the top horizontal axis and the pin 13.3.*a* is blocked into the blocking step 13.3.*c*.

The elastic band 13.3.*b* holds the pin 13.3.*a* in permanent locked position. The unlocking takes place by pressing button 9 whereby the pin 13.3.*a* overcomes the blocking step 13.3.*c* and slides along plane B. The elastic band 13.3.*b* pulls substantially flat element 5 towards axis 2 and facilitates the movement until reaching en end position, chair or desk. When the end position is reached, substantially flat element 5 locks into position automatically.

In the transformation from a chair into a desk according to the invention, FIG. 4 (FIG. 4*a*–FIG. 4*e*) and FIG. 8 (FIG. 8*a*–FIG. 8*e*), the button 9 is pressed and held until the transformation starts; then it is released. The second substantially flat element 6 is lifted to end top position using handle 10. Here the second substantially flat element 6 rotates round the bottom horizontal axis 3 until it reaches the nearly vertical position of a front panel; at the same time, the first substantially flat element 5, with the help of the slot 7, moves in relation to the top horizontal axis 2, turns around it simultaneously and reaches end horizontal position as a desk top. After the transformation is complete, the fixing mechanism automatically locks into position the first substantially flat element 5.

In the transformation from a desk into a chair, the button 9 is pressed and held until the transformation starts; then it is released. By means of the handle 10 the second substantially flat element 6 is rotated round the bottom horizontal axis 3 until reaching the horizontal position of a seat. After the transformation is complete, the fixing mechanism automatically locks into position the first substantially flat element 5.

In the process of transformation, the slot 7 ensures the movement of the first substantially flat element 5 in relation to the top horizontal axis 2 and the rotation around it, while at the same time the second substantially flat element 6 turns around the bottom horizontal axis 3; the hinge joint ensures the leaning of the substantially flat elements towards each other and the distancing, or vice versa.

The chair that transforms into a desk can be used in conference halls, offices, training rooms, the home, public areas, etc. It ensures the availability of the necessary number of chairs and desks depending on the concrete needs. It is suitable for use in the home and small-size terraces. Executed as a small model it can be used as a toy.

The invention claimed is:

1. An item of transformable furniture comprising:

a first plate and a second plate connected with each other by a horizontal hinge joint;

a first horizontal axis parallel to an axis of said hinge joint and associated with said first plate so that said first plate can rotate around said first horizontal axis;

a second horizontal axis parallel to said axis of said hinge joint and located at a different level than said first horizontal axis, said second horizontal axis associated with said second plate so that said second plate can rotate about said second horizontal axis; and a fixing mechanism that releasably fixes the angular position between said plates and allows the plates to switch between and be releasably secured in a first position as a seat and a back and a second position as a front panel and a worktop.

2. An item of transformable furniture according to claim 1, further comprising a supporting construction associated with said first plate and said second plate comprising a first lateral vertical element and a second later vertical element linked together at a distance from one another, so that said first plate and said second plate are located between said first and second linked lateral vertical elements.

3. An item of transformable furniture according to claim 2, wherein said first and second linked lateral vertical elements are formed as closed frames with armrests in an upper part of the respective frame or as open frames without armrests.

4. An item of transformable furniture according to claim 2, wherein said first and second linked lateral vertical elements are formed as solid lateral vertical elements.

5. An item of transformable furniture according to claim 1, wherein the second plate serving as a back and worktop is connected to the second horizontal axis by means of a slot which enables a rotational and translational movement of the plate in relation to said axis.

6. An item of transformable furniture according to claim 5 wherein the first plate serving as a seat and front panel is penetrated by the first horizontal axis.

7. An item of transformable furniture according to claim 1, wherein the fixing mechanism is located in one of said plates.

8. An item of transformable furniture according to claim 1, wherein the fixing mechanism is located in the hinge joint.

9. An item of transformable furniture according to claim 1, wherein said first plate has a slot that receives said first horizontal axis therein and said first horizontal axis is adapted to slide along said slot to allow said chair to transform into said desk.

10. An item of transformable furniture comprising:

a first plate and a second plate connected with each other by a horizontal hinge joint;

a first horizontal axis parallel to an axis of said hinge joint and associated with said first plate so that said first plate can rotate around said first horizontal axis;

a second horizontal axis parallel to said axis of said hinge joint and located at a different level than said first horizontal axis, said second horizontal axis associated with said second plate so that said second plate can rotate about said second horizontal axis; and a fixing mechanism associated with one of said first plate, said second plate and said hinge joint;

wherein the fixing mechanism allows the plates to switch between and be releasably secured in a first position as a seat and a back and a second position as a front panel and a worktop.

11. An item of transformable furniture according to claim 10, further comprising a supporting construction associated with said first plate and said second plate comprising a first lateral vertical element and a second later vertical element linked together at a distance from one another, so that said first plate and said second plate are located between said first and second linked lateral vertical elements.

12. An item of transformable furniture according to claim 11, wherein said first and second linked lateral vertical elements are formed as closed frames with armrests in an upper part of the respective frame or as open frames without armrests.

13. An item of transformable furniture according to claim 11, wherein said first and second linked lateral vertical elements are formed as solid lateral vertical elements.

14. An item of transformable furniture according to claim 11, wherein the second plate serving as a back and worktop is connected to the second horizontal axis by means of a slot which enables a rotational and translational movement of the plate in relation to said axis.

15. An item of transformable furniture according to claim 14 wherein the first plate serving as a seat and front panel is penetrated by the first horizontal axis.

16. An item of transformable furniture according to claim 10, wherein said fixing mechanism fixes the angular position between said plates.

17. An item of transformable furniture according to claim 16, wherein the fixing mechanism is located in one of said plates.

18. An item of transformable furniture according to claim 16, wherein the fixing mechanism is located in the hinge joint.

19. An item of transformable furniture according to claim 10, wherein said first plate has a slot that receives said first horizontal axis therein and said first horizontal axis is adapted to slide along said slot to allow said chair to transform into said desk.

20. A chair capable of being transformed into a desk and vice versa, comprising:

a supporting construction;

a first horizontal axis associated with said supporting construction;

a second horizontal axis associated with said supporting construction and spaced from said first horizontal axis;

a first substantially flat element having a slot that receives said first horizontal axis therein;

a second substantially flat element associated with said second horizontal axis and connected to said first substantially flat element by a hinge joint; and a fixing mechanism associated with one of said first substantially flat element, said second substantially flat element and said hinge joint;

wherein said first horizontal axis is adapted to slide along said slot to allow said chair to transform into said desk; and wherein said fixing mechanism is adapted to releasably fix the angular position of the first and second substantially flat elements.

* * * * *

UNITED STATES PATENT AND TRADEMARK OFFICE

CERTIFICATE OF CORRECTION

PATENT NO. : 7,207,623 B2
APPLICATION NO. : 10/526310
DATED : April 24, 2007
INVENTOR(S) : Milinov et al.

It is certified that error appears in the above-identified patent and that said Letters Patent is hereby corrected as shown below:

On Title page, In 73, please delete, "JRT Joint-Stock Company" and insert --ORT Joint-Stock Company--.

Signed and Sealed this

Fourteenth Day of August, 2007

JON W. DUDAS
*Director of the United States Patent and Trademark Office*